US007058569B2

(12) United States Patent
Coorman et al.

(10) Patent No.: US 7,058,569 B2
(45) Date of Patent: Jun. 6, 2006

(54) FAST WAVEFORM SYNCHRONIZATION FOR CONCENTRATION AND TIME-SCALE MODIFICATION OF SPEECH

(75) Inventors: Geert Coorman, Kortrijk (BE); Bert Van Coile, Brugge (BE)

(73) Assignee: Nuance Communications, Inc., Burlington, MA (US)

( * ) Notice: Subject to any disclaimer, the term of this patent is extended or adjusted under 35 U.S.C. 154(b) by 614 days.

(21) Appl. No.: 09/953,075

(22) Filed: Sep. 14, 2001

(65) Prior Publication Data

US 2002/0143526 A1 Oct. 3, 2002

Related U.S. Application Data

(60) Provisional application No. 60/233,031, filed on Sep. 15, 2000.

(51) Int. Cl.
*G10L 19/00* (2006.01)

(52) U.S. Cl. ..... 704/216

(58) Field of Classification Search ..... 704/216, 704/231, 265, 270, 208, 260, 269, 249, 264; 395/2.74, 2.76, 2.77, 2.09; 381/43
See application file for complete search history.

(56) References Cited

U.S. PATENT DOCUMENTS

| | | | | |
|---|---|---|---|---|
| 4,665,548 | A * | 5/1987 | Kahn | 704/237 |
| 5,490,234 | A | 2/1996 | Narayan | 395/2.69 |
| 5,524,172 | A * | 6/1996 | Hamon | 704/268 |
| 5,617,507 | A * | 4/1997 | Lee et al. | 704/200 |
| 5,659,664 | A * | 8/1997 | Kaja | 704/265 |
| 5,740,320 | A * | 4/1998 | Itoh | 704/267 |
| 5,787,398 | A * | 7/1998 | Lowry | 704/268 |
| 5,845,250 | A * | 12/1998 | Vogten | 704/270 |
| 5,862,519 | A * | 1/1999 | Sharma et al. | 704/231 |
| 5,897,617 | A * | 4/1999 | Collier | 704/260 |
| 5,933,805 | A * | 8/1999 | Boss et al. | 704/249 |
| 6,052,664 | A | 4/2000 | Van Coile et al. | 704/260 |
| 6,067,519 | A * | 5/2000 | Lowry | 704/264 |
| 6,173,255 | B1 * | 1/2001 | Wilson et al. | 704/216 |
| 6,366,883 | B1 | 4/2002 | Campbell et al. | 704/260 |

OTHER PUBLICATIONS

Moulines et al., A real-time french text-to-speech system generating high-quality synthetic speech 1990, IEEE, pp. 309-312.*

Hamon et al., A diphone synthesis system based on time-domain prosodic modifications of spech 1989, IEEE, pp. 238-241.*

(Continued)

*Primary Examiner*—Wayne Young
*Assistant Examiner*—Jakieda Jackson
(74) *Attorney, Agent, or Firm*—Bromberg & Sunstein LLP

(57) ABSTRACT

A synthesis method for concatenative speech synthesis is provided for efficiently concatenating waveform segments in the time-domain. A digital waveform provider produces an input sequence of digital waveform segments. A waveform concatenator concatenates the input segments by using waveform blending within a concatenation zone to synchronize, weight, and overlap-add selected portions of the input segments to produce a single digital waveform. The synchronizing includes determining a minimum weighted energy anchor in the selected portion of each input segment and aligning synchronization peaks in a local vicinity of each anchor.

50 Claims, 4 Drawing Sheets

OTHER PUBLICATIONS

Black, A. W., et al "Optimising Selecton of Units from Speech Databases for Concatenative Synthesis" *ESCA Eurospeech '95* 4th European Conference on Speech Communication and Technology, Madrid, Sep. 1995, , vol. 1, Conf. 4, Sep. 18, 1995, pp. 581-584.

Dutoit, T., et al "MBR-PSOLA: Text-to-Text Synthesis Based on an MBE Re-Synthesis of the Segments Database", *Speech Communication*, Elsevier Science Publishers, Amsterdam, NL, vol. 13, No. 3/4, Dec. 1, 1993, pp. 435-440.

Klabbers, E. "High-Quality Speech Output Generation Through Advanced Phrase Concatenation", *Proc. Of the Cost Workshop on Speech Technology in the Public Telephone Network: Where are We Today*?, vol. 1, No. 88, 1997, XP002195704, Rhodes, Greece.

Lamel, L. F., et al "Generation and Synthesis of Broadcast Messages", *Proc. ESCA-Nato Workshop: Applications of Speech Technology*, Sep. 1993. pp. 1-4.

Lawlor, B., et al "A Novel High quality Efficient Algorithm for Time-Scale Modification of Speech", *Proceedings of the Eurospeech Conferencel*, vol. 6, 1999, pp. 2785-2788, XP002196162, Budapest, Hungary.

Stylianou, Y. "Synchronization of Speech Frames Based on Phase Data with Application to concatenative Speech Synthesis", *Proceedings of the 7th European Conference on Speech Communication and Technology*, Sep. 5-9, 1999, pp. 2343-2346, XP002196163 Budapest, Hungary.

Verhelst, W., et al "An Overlap-Add Technique Basedon Waveform Similarity (WSOLA) for High Quality Time-Scale Modification of Speech" *ICASSP-93*, 1993 IEEE International Conference on Acoustics, Speech and signal Processing (Cat. No. 92CH3252-4) proceedings of ICASSP '93, Minneapolis, MN, USA, Apr. 27-30, 1993, pp. 554-557, vol. 2. XP002195649 1993, NY, NY, USA, IEEE, USA ISBN: 0-7803-0946-4.

* cited by examiner

BLOCK 120 AND 121 ARE OPTIONAL IN CORPUS-BASED SYTHESIS

FAST WAVEFORM SYNCHRONIZATION FOR CONCENTRATION AND TIME-SCALE MODIFICATION OF SPEECH

Claims benefit of Ser. No. 60/233,031 Sep. 15, 2000.

FIELD OF THE INVENTION

The present invention relates to speech synthesis, and more specifically, changing the speech rate of sampled speech signals and concatenating speech segments by efficiently joining them in the time-domain.

BACKGROUND OF THE INVENTION

Speech segment concatenation is often used as part of speech generation and modification algorithms. For example, many Text-To-Speech (TTS) applications concatenate pre-stored speech segments in order to produce synthesized speech. Also, some Time Scale Modification (TSM) systems fragment input speech into small segments and rejoin the segments after repositioning. Junctions between speech segments are a possible source of degradation in speech quality. Thus, signal discontinuities at each junction should be minimized.

Speech segments can be concatenated either in the time-, frequency- or time-frequency-domain. The present invention is about time-domain concatenation (TDC) of digital speech waveforms. High quality joining of digital speech waveforms is important in a variety of acoustic processing applications, including concatenative text-to-speech (TTS) systems such as the one described in U.S. patent application Ser. No. 09/438,603 by G. Coorman et al.; broadcast message generation as described, for example, in L. F. Lamel, J. L. Gauvain, B. Prouts, C. Bouhier & R. Boesch, "*Generation and Synthesis of Broadcast Messages*," Proc. ESCA-NATO Workshop on Applications of Speech Technology, Lautrach, Germany, September 1993; implementing carrier-slot applications, as described, for example, in U.S. Pat. No. 6,052,664 by S. Leys, B. Van Coile and S. Willems; and Time-Scale Modifications (TSM) as described, for example, in U.S. patent application Ser. No. 09/776,018, G. Coorman, P. Rutten, J. De Moortel and B. Van Coile, "Time Scale Modification of Digitally Sampled Waveforms in the Time Domain," filed Feb. 2, 2001; all of which are hereby incorporated herein by reference.

TDC avoids computationally expensive transformations to and from other domains, and has the further advantage of preserving intrinsic segmental information in the waveform. As a consequence, for longer speech segments, the natural prosodic information (including the micro-prosody-one of the key factors for highly natural sounding speech) is transferred to the synthesized speech. One major concern of TDC is to avoid audible waveform irregularities such as discontinuities and transients that may occur in the neighborhood of the join. These are commonly referred as "concatenation artifacts".

To avoid concatenation artifacts, two speech segments can be joined together by fading-out the trailing edge of the left segment and fading-in the leading edge of the right segment before overlapping and adding them. In other words, smooth concatenation is done by means of weighted overlap-and-add, a technique that is well known in the art of digital speech processing. Such a method has been disclosed in U.S. Pat. No. 5,490,234 by Narayan, incorporated herein by reference.

Thus, rapid and efficient synchronization of waveforms helps achieve real time high quality TDC. The length of the speech segments involved depends on the application. Small speech segments (e.g. speech frames) are typically used in time-scale modification applications while longer segments such as diphones are used in text-to-speech applications and even longer segments can be used in domain specific applications such as carrier slot applications.

Some known waveform synchronization techniques address waveform similarity as described in W. Verhelst & M. Roelands, "*An Overlap-Add Technique Based on Waveform Similarity (WSOLA) for High Quality Time-Scale Modification of Speech*," ICASSP-93. IEEE International Conference on Acoustics, Speech, and Signal Processing, pages 554–557, Vol. 2, 1993; incorporated herein by reference. In the following, waveform synchronization methods used in TDC that makes use of the waveform shape will be described. This type of synchronization minimizes waveform discontinuities in voiced speech that could emerge when joining two speech waveform segments.

A common method of synthesizing speech in text-to-speech (TTS) systems is by combining digital speech waveform segments extracted from recorded speech that are stored in a database. These segments are often referred in speech processing literature as "speech units". A speech unit used in a text-to-speech synthesizer is a set consisting of a sequence of samples or parameters that can be converted to waveform samples taken from a continuous chunk of sampled speech and some accompanying feature vectors (containing information such as prominence level, phonetic context, pitch . . . ) to guide the speech unit selection process, for example. Some common and well described representations of speech units used in concatenative TTS systems are frames as described in R. Hoory & D. Chazan, "*Speech synthesis for a specific speaker based on labeled speech database*", 12$^{th}$International Conference On Pattern Recognition 1994, Vol. 3, pp. 146–148, phones as described in A. W. Black, N. Campbell, "*Optimizing selection of units from speech databases for concatenative synthesis*," Proc. Eurospeech '95, Madrid, pp. 581–584, 1995, diphones as described in P. Rutten, G. Coorman, J. Fackrell & B. Van Coile, "*Issues in Corpus-based Speech Synthesis*", Proc. IEE symposium on state-of-the-art in Speech Synthesis, Savoy Place, London, April 2000, demi-phones as described in M. Balestri, A. Pacchiotti, S. Quazza, P. L. Salza, S. Sandri, "*Choose the best to modify the least: a new generation concatenative synthesis system*," Proc. Eurospeech '99, Budapest, pp. 2291–2294, September 1999 and longer segments such as syllables, words and phrases as described in E. Klabbers, "*High-quality speech output generation through advanced phrase concatenation*", Proc. of the COST Workshop on Speech Technology in the Public Telephone Network: Where are we today?, Rhodes, Greece, pages 85–88, 1997, all of which are incorporated herein by reference.

A well known speech synthesis method that implicitly uses waveform concatenation is described in a paper by E. Moulines and F. Charpentier "*Pitch-Synchronous Waveform Processing Techniques for Text-to-Speech Synthesis Using Diphones*", Speech Communication, Vol. 9, No. 5/6, December 1990, pages 453–467, incorporated herein by reference. That paper describes a technique known as TD-PSOLA (Time-Domain Pitch-Synchronous Over-Lap and Add) that is used for prosody manipulation of the speech waveform and concatenation of speech waveform segments. A TD-PSOLA synthesizer concatenates windowed speech segments centered on the instant of glottal closure (GCI) that have a typical duration of two pitch periods. Several techniques have been used to calculate the GCI. Amongst others:

B. Yegnanarayana and R. N. J. Veldhuis, "*Extraction Of Vocal-Tract System Characteristics From Speech Signals*", IEEE Transactions on Speech and Audio Processing, Vol. 6, pp. 313–327, 1998;

C. Ma, Y. Kamp & L. Willems, "*A Frobenius Norm Approach To Glottal Closure Detection From The Speech Signal*", IEEE Transactions on Speech and Audio Processing, 1994;

S. Kadambe and G. F. Boudreaux-Bartels, "*Application Of The Wavelet Transform For Pitch Detection Of Speech Signals*", IEEE Transactions on Information Theory, vol. 38, no 2, pp. 917–924, 1992;

R. Di Francesco & E. Moulines, "*Detection Of The Glottal Closure By Jumps In The Statistical Properties Of The Signal*", Proc. of Eurospeech '89, Paris, vol. 2, pp. 39–41, 1989; all incorporated herein by reference.

In PSOLA synthesis, diphone concatenation is performed by means of overlap-and-add (i.e. waveform blending). The synchronization is based on a single feature, namely the instant of glottal closure (pitch markers, GCI). The PSOLA method is fast and lends itself to off-line calculation of the pitch markers leading to very fast synchronization. A disadvantage of this technique is that phase differences between segment boundaries may cause waveform discontinuities and thus may lead to audible clicks. A technique which aims to avoid such problems is the MBROLA synthesis method that is described in T. Dutoit & H. Leich, "*MBR-PSOLA: Text-to-Speech Synthesis Based on an MBE Re-Synthesis of the Segments Database*", Speech Communication, Vol. 13, pages 435–440, incorporated herein by reference. The MBROLA technique pre-processes the segments of the inventory by equalization of the pitch period over the complete segment database and by resetting the low frequency phase components to a pre-defined value. This technique facilitates spectral interpolation. MBROLA has the same computational efficiency as PSOLA and its concatenation is smoother. However MBROLA makes the synthesized speech more metallic sounding because of the pitch-synchronous phase resets.

In the field of corpus-based synthesis another efficient segment concatenation method has been proposed recently in Y. Stylianou, "*Synchronization of Speech Frames Based on Phase Data with Application to Concatenative Speech Synthesis*," Proceedings of 6th European Conference on Speech Communication and Technology, Sep. 5–9, 1999, Budapest, Hungary, Vol. 5, pp. 2343–2346, incorporated herein by reference. Stylianou's method is based on the calculation of the center of gravity. This method is somewhat similar to the epoch estimation method used for TD-PSOLA synthesis but is more robust since it does not rely on an accurate pitch estimate.

Another efficient waveform synchronization technique described in S. Yim & B. I. Pawate, "*Computationally Efficient Algorithm for Time Scale Modification* (*GLS-TSM*)", IEEE International Conference on Acoustics, Speech, and Signal Processing Conference Proceedings, pp. 1009–1012 Vol. 2, 1996, incorporated herein by reference, (see also U.S. Pat. No. 5,749,064) is based on a cascade of a global synchronization with a local synchronization based on a vector of signal features.

In the method described in B. Lawlor & A. D. Fagan, "*A Novel High Quality Efficient Algorithm for Time-Scale Modification of Speech*," Proceedings of Eurospeech conference, Budapest, Vol. 6, pp. 2785–2788, 1999, incorporated herein by reference, the largest peaks or troughs are used as a synchronization criterion.

SUMMARY OF THE INVENTION

The present invention provides an apparatus for concatenating a first quasi-periodic digital waveform segment with a second quasi-periodic digital waveform segment, such that the trailing part of the first waveform segment and leading part of the second waveform segment are concatenated smoothly. The concatenation is done by means of overlap-and-add, a technique well known in the art of speech processing. The waveform synchronizer/concatenator determines an optimum blend point for the first and second digital waveform segments in order to minimize audible artifacts near the join. The waveform regions centered around the optimal blend points are overlapped in time and added to generate a digital waveform sequence representing a concatenation of the first and second digital waveform segment. The technique is applicable to concatenate any two quasi-periodic waveforms, commonly encountered in the synthesis of sound, voiced speech, music or the like.

BRIEF DESCRIPTION OF THE DRAWINGS

The present invention will be more readily understood by reference to the following detailed description taken with the accompanying drawings, in which.

DETAILED DESCRIPTION OF SPECIFIC EMBODIMENTS

Figure 1:
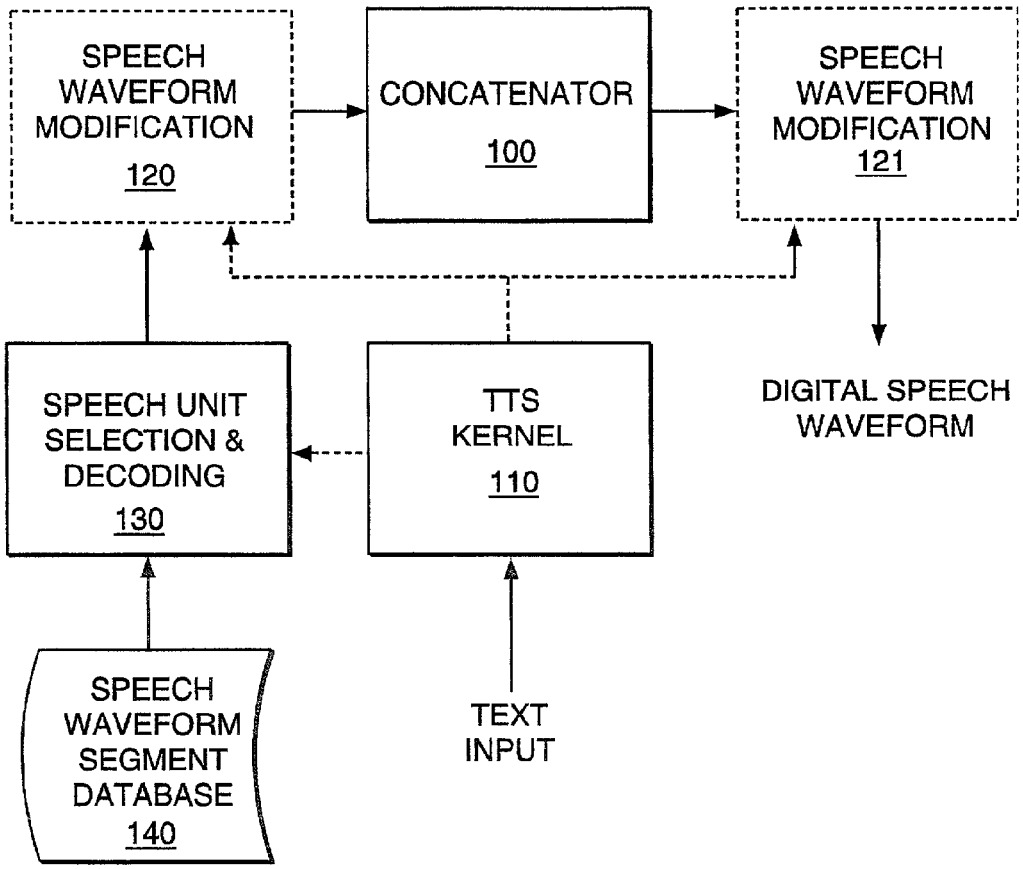
FIG. 1 gives a general functional view of the waveform synchronization mechanism embedded in a waveform concatenator.

Before leaping to the specific details of our invention, some underlying signal processing aspects will be discussed, starting with the theory behind detection of the concatenation points and the distortion caused by the concatenation of two speech segments $x_1(n)$ and $X_2(n)$. The signal after concatenating is described as y(n).

In order to minimize concatenation artifacts, the concatenated signal y(n) is analyzed in the neighborhood of the join. In what follows index Lcorresponds with the time-index of the join, and it is also assumed that the distortion to the left and to the right of the join have the same importance (i.e. same weight). Inside the concatenation interval, y(n) is a mixture of $x_1(n)$ and $x_2(n)$. The signal y(n) toward the left side of the concatenation zone corresponds to part of the segment extracted from $x_1(n)$, and toward the right side of the concatenation zone corresponds to part of the segment extracted from the signal $x_2(n)$. Their respective concatenation points are described as $E_1$ and $E_2$. In order to minimize the distortion caused by concatenation a concatenation point is selected, based on a synchronization measure, from a set of potential concatenation points that lay in a (small) time interval called the optimization zone. The optimization zone is typically located at the edges of the speech segments (where the concatenation should take place).

At a distance D from the left side of the join after concatenation, a short-time (ST) Fourier spectrum Y(ω,L−D) of y(n) is expected that closely resembles that of $X_1(\omega, E_1-D)$, the ST Fourier spectrum of $x_1(n)$ around $E_1$. Similarly at the right side of the join, a ST spectrum Y(ω,L+D) is expected that closely resembles $X_2(\omega,E_2+D)$, the ST spectrum of $x_2(n)$ around time-index $E_2$.

As an approximation for the perceived quality, the spectral distortion may be defined as the mean squared error between the spectra:

$$\xi = \frac{1}{2\pi}\int_{-\pi}^{\pi}|Y(\omega, L-D) - X_1(\omega, E_1-D)|^2 d\omega + \frac{1}{2\pi}\int_{-\pi}^{\pi}|Y(\omega, L+D) - X_2(\omega, E_2+D)|^2 d\omega$$

The well-known Parseval's relation can be used to reformulate ξ in the time-domain:

$$\xi = \sum_{n=-\infty}^{\infty}(y(n+L)w(n+D) - x_1(n+E_1)w(n+D))^2 + \sum_{n=-\infty}^{\infty}(y(n+L)w(n-D) - x_2(n+E_2)w(n-D))^2 \quad (1)$$

Where w(n) is the window (e.g. Blackman window) that was used to derive the short-time Fourier transform.

Concatenation artifacts are minimized (in the least mean square sense) by minimizing ξ. The minimization of the spectral distortion ξ through the condition $$\frac{\partial \xi}{\partial y(n)} = 0$$

leads to an expression for the "optimal" concatenated signal y(n) y(n) in the neighborhood of L:

$$y(n+L) = \frac{x_1(n+E_1)w^2(n+D) + x_2(n+E_2)w^2(n-D)}{w^2(n+D) + w^2(n-D)} \quad n \in [-D, D] \quad (2)$$

The concatenation of the two segments can thus be readily expressed in the well-known weighted overlap-and-add (OLA) representation as described in D. W. Griffin & J. S. Lim. "*Signal Estimation From Modified Short-Time Fourier Transform*", IEEE Trans. Acoustics, Speech and Signal Processing, Vol. ASSP-32(2), pp. 236–243, April 1984, incorporated herein by reference. The overlap and-add procedure for segment concatenation is no more than a (non-linear) short time cross-fade of speech segments. The minimization of the distortion, however, resides in the technique that finds the regions of optimal overlap by appropriately modifying $E_1$ and $E_2$ by a small value in such a way that $E_1$ and $E_2$ stay in their respective optimization intervals.

By choosing the length of the window w(n) equal to 4D+1, a class of symmetrical windows (around time-index n=0) may be defined that normalize the denominator of the above equation:

$$w^2(n+D)+w^2(n-D)=1 \text{ for } n\epsilon[-D,D] \quad (3)$$

To ensure signal continuity at the boundaries of the concatenation zone, choose w(0)=1. This means that the effective length of the window w is only 4D−1 samples long.

The expression for the concatenated signal y(n) can be further simplified by substituting (3) in (2):

$$y(n+L) = \begin{cases} x_1(n+E_1)w^2(n+D) + x_2(n+E_2)(1-w^2(n+D)) & n \in [-D, D] \\ x_1(n+E_1) & n < -D \\ x_2(n+E_2) & n > D \end{cases} \quad (4)$$

The above equation (4) now may be substituted in the expression for the distortion ξ (1) to eliminate y(n). In that way, the error may be expressed solely as a function of the positions of the left and right cutting points.

$$\xi(E_1, E_2) = \sum_{n=-\infty}^{\infty} w^2(n+D)(1-w^2(n+D))(x_1(n+E_1) - x_2(n+E_2))^2$$

In other words, minimization of the concatenation artifacts can be performed by minimizing the weighted mean square error. This can be further expanded in terms of energy as follows:

$$\xi(E_1, E_2) = \sum_{n=-\infty}^{\infty} w^2(n+D)(1-w^2(n+D))x_1^2(n+E_1) + \sum_{n=-\infty}^{\infty} w^2(n+D)(1-w^2(n+D))x_2^2(n+E_2) - 2\sum_{n=-\infty}^{\infty} w^2(n+D)(1-w^2(n+D))x_1(n+E_1)x_2(n+E_2) \quad (5)$$

Equation (5) can be further simplified if the window w(n) is chosen to be the following trigonometric window:

$$w(n) = \begin{cases} \cos\left(\frac{n\pi}{4D}\right) & n \in [-2D, 2D] \\ 0 & \text{otherwise} \end{cases} \quad (6)$$

where w(n) satisfies the normalization constraint (3) and is related to the popular Hanning window.

The error may now be simplified to the following expression:

$$\xi(E_1, E_2) = \frac{1}{4}\sum_{n=-D}^{D}\left(x_1(n+E_1)\cos\left(\frac{n\pi}{2D}\right)\right)^2 + \frac{1}{4}\sum_{n=-D}^{D}\left(x_2(n+E_2)\cos\left(\frac{n\pi}{2D}\right)\right)^2 - \frac{1}{2}\sum_{n=-D}^{D}\left(x_1(n+E_1)\cos\left(\frac{n\pi}{2D}\right)\right)\left(x_2(n+E_2)\cos\left(\frac{n\pi}{2D}\right)\right) \quad (7)$$

Figure 3:
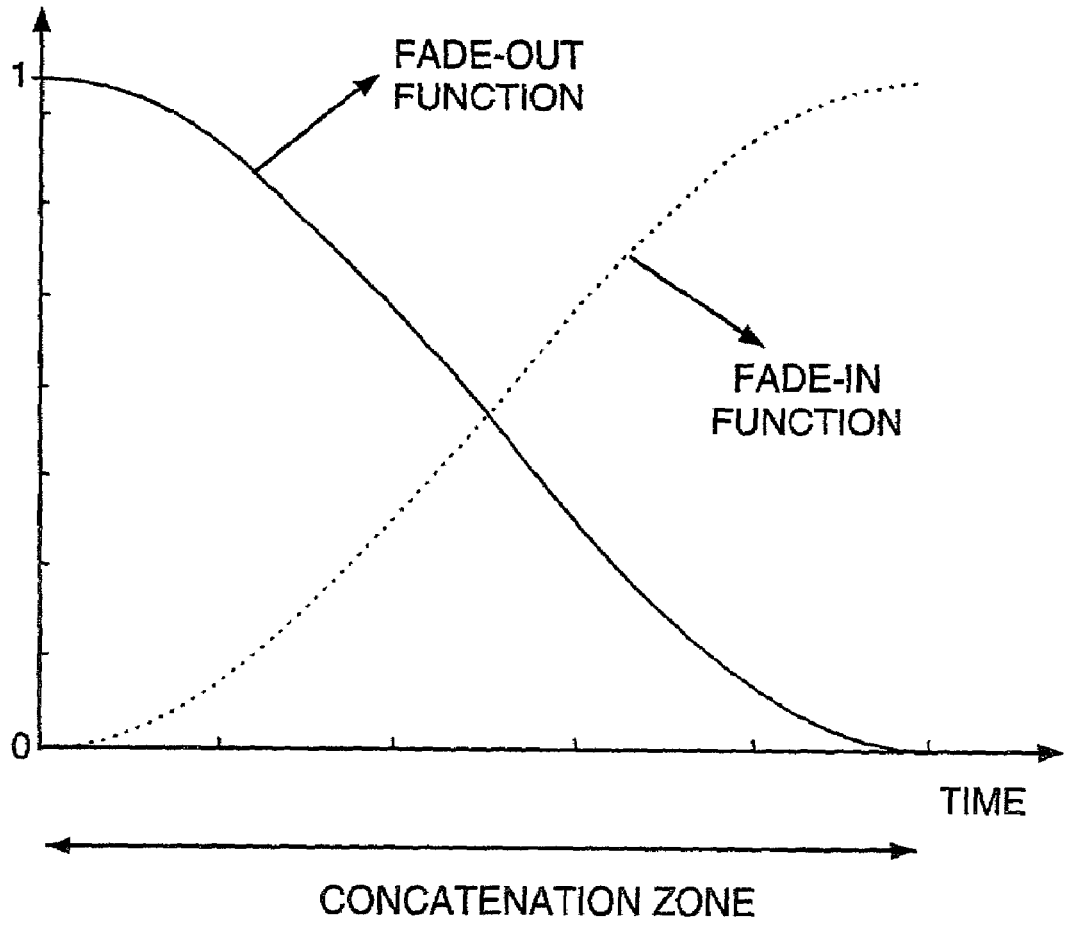
FIG. 3 shows the typical shapes of the fade-in and fade-out functions that are used in the waveform blending process.

The fade-in and fade-out functions that are used for the waveform blending resulting from the window (6) are shown in FIG. 3.

From the above equation (7), the minimization of the distortion $\xi$ is shown to be a compromise between the minimization of the energy of the weighted segment at the left and right side of the join (i.e. first two terms) and the maximization of the cross-correlation between the left and the right weighted segment (third term).

It should be noted that the distortion minimization in the least mean square sense is interesting because it leads to an analytical representation that delivers insight into the problem solution. The distortion as it is defined here does not take into account perceptual aspects such as auditory masking and non-uniform frequency sensitivity. In the case when the two waveforms are very similar in the neighborhood of their joining points, then the minimization of the three terms in equation (7) is equivalent to the maximization of the cross-correlation only (i.e. waveform similarity condition), while if the two waveform segments are uncorrelated, the best optimization criterion that can be chosen is the energy minimization in the neighborhood of the join.

The concatenation of unvoiced speech waveform segments can be done by means of energy minimization only because the cross-correlation is very low. However, in the phoneme nucleus, most unvoiced segments are of a stationary nature that makes minimization on basis of energy useless. Unsynchronized OLA based concatenation is thus appropriate for the unvoiced case. On the other hand concatenation of voiced speech waveforms requires the minimization of the energy terms and the maximization of the cross-energy term. Voiced speech has a clear quasi-periodic structure and its wave shape may differ between the speech segments that are used for concatenation. Therefore it is important to find the right balance between the waveform similarity condition and the minimum energy condition.

The distortion represented by equation (7) is composed as a sum of three different energy terms. The first two terms are energy terms while the third term is a "cross-energy" term. It is well known that representing the energy in the logarithmic domain rather than in the linear domain better corresponds to the way humans perceive loudness. In order to weight the energy terms approximately perceptually equally, the logarithm of those terms may be taken individually.

To avoid problems with possible negative cross-correlations, it may be useful to further consider this approach. It is well known from mathematics that the sum of logarithms is the logarithm of the product, and that subtraction of logarithms corresponds to the logarithm of the quotient. In other words, additions become multiplications and subtractions become divisions in the optimization formula. The minimization of the logarithm of a function that is bounded by 1 is equivalent to the maximization of the function without the log operator. The minimization of the spectral distortion in the log-domain corresponds to the maximization of the normalized cross-correlation function:

$$\rho(E_1, E_2) = \frac{\sum_{n=-D}^{D}\left(x_1(n+E_1)\cos\left(\frac{n\pi}{2D}\right)\right)\left(x_2(n+E_2)\cos\left(\frac{n\pi}{2D}\right)\right)}{\sqrt{\sum_{n=-D}^{D}\left(x_1(n+E_1)\cos\left(\frac{n\pi}{2D}\right)\right)^2\sum_{n=-D}^{D}\left(x_2(n+E_2)\cos\left(\frac{n\pi}{2D}\right)\right)^2}} \quad (8)$$

Listening experiments suggest that the normalized cross-correlation is a very good measure to find the best concatenation points $E_1$ and $E_2$.

The concatenation of the two segments can be readily expressed in the well-known weighted overlap-and-add (OLA) representation. The short time fade-in/fade-out of speech segments in OLA will be further referred to as waveform blending. The time interval over which the waveform blending takes place is referred to as the concatenation zone. After optimization, two indices $E_1^{Opt}$ and $E_2^{Opt}$ are obtained that will be called the optimal blending anchors for the first and second waveform segments respectively.

To achieve high-quality waveform blending, the two blending anchors $E_1$ and $E_2$ vary over an optimization interval in the trailing part of the first waveform segment and in the leading part of the second waveform segment respectively such that the spectral distortion due to blending is minimized according to a given criterion; for example, maximizing the normalized cross-correlation of equation (8). The trailing part of the first speech segment and the leading part of the second speech segment are overlapped in time such that the optimal blending anchors coincide. The waveform blending itself is then achieved by means of overlap-and-add, a technique well known in the art of speech processing.

In one representative embodiment, the distance D from the left side of the join is chosen to be approximately equal to the average pitch period P derived from the speech database from which the waveforms $x_1(n)$ and $x_2(n)$ were taken. The optimization zones over which $E_1$ and $E_2$ vary are also of the order of P. The computational load of this optimization process is sampling-rate dependent and is of the order of $P^3$.

Embodiments of the present invention aim to reduce the computational load for waveform concatenation while avoiding concatenation artifacts. A distinction is made between speech synthesis systems that are based on small speech segment inventories such as the traditional diphone synthesizers such as L&H TTS-3000™, and systems based on large speech segment inventories such as the ones used in corpus-based synthesis. It will be appreciated that digital waveforms, short-time Fourier Transforms, and windowing of speech signals are commonplace in audio technology.

Representative embodiments of the present invention provide a robust and computationally efficient technique for time-domain waveform concatenation of speech segments. Computational efficiency is achieved in the synchronization of adjacent waveform segments by calculating a small set of elementary waveform features, and by using them to find the appropriate concatenation points. These waveform-deduced features can be calculated off-line and stored in moderately sized tables, which in turn can be used by the real-time waveform concatenator. Before and after concatenation, the digital waveforms may be further processed in accordance with methods that are familiar to persons skilled in the art of speech and audio processing. It is to be understood that the method of the invention is carried out in electronic equipment and the segments are provided in the form of digital waveforms so that the method corresponds to the joining of two or more input waveforms into a smaller number of output waveforms.

Combination Matrix Approach for Polyphone Concatenation Based on Small Speech Segment Inventories Small footprint speech synthesizers such as L&H TTS-3000™ or TD-PSOLA synthesis have a relative small inventory of speech segments such as diphone and triphone speech segments. In order to reduce the computational complexity, a combination matrix containing the optimal blending anchors $E_1^{OPT}$ and $E_2^{Opt}$ for each waveform combination can be calculated in advance for all possible speech segment combinations.

For most languages, a typical diphone database contains more than 1000 different segments. This would require more than a million (=1000×1000) different entries in the combination matrix. Such large matrices are often inappropriate for small footprint systems. Instead, it is possible to create for each phoneme separately a combination matrix. This approach leads to a set of phoneme-dependent combination matrices that occupy only a fraction of the memory that would be required to store the global combination matrix calculated over the complete waveform segment database.

However, when working in a phoneme-dependent way, attention should be paid to the issue of phoneme substitution. Phoneme substitution is a technique well known in the art of speech synthesis. Phoneme substitution is applied when certain phoneme combinations do not occur in the speech segment database. If phoneme substitutions occur, then the waveform segments that are to be concatenated have a different phonetic content and the optimal blending anchors are not stored in the phoneme-dependent combination matrices. In order to avoid this problem, substitution should be performed before calculating the combination matrices.

The easiest way to accomplish this is by off-line substitution. Off-line substitution re-organizes the segment lookup data structures that contain the segment descriptors in such a way that the substitution process becomes transparent for the synthesizer. A typical substitution process will fill the empty slots in the segment lookup data structure by new speech segment descriptors that refer to a waveform segment in the database in such a way that the waveform segment resembles more or less to the phonetic representation of the descriptor.

It is not necessary to construct combination matrices for unvoiced phonemes such as unvoiced fricatives. This may further lead to a significant but language-dependent memory saving.

Fast Waveform Synchronization Method

Corpus-based synthesis as described in P. Rutten, G. Coorman, J. Fackrell & B. Van Coile, "*Issues in Corpus-Based Speech Synthesis*," Proc. IEEE symposium on State-of-the-Art in Speech Synthesis, Savoy Place, London, April 2000, uses large databases typically containing hundreds of thousands of speech segments to synthesize high quality natural sounding speech. The creation of a combination matrix as discussed above is not always practical because the size of the combination matrix is more or less quadratically related to the size of the segment database, while current hardware platforms have limited memory capacity. The same remarks apply to time-scale modification.

The minimization of the error based on the three energy terms as given in equation (7) is time-consuming and depends heavily on the sampling-rate. In a representative embodiment of the invention, a simpler technique is used to calculate the optimal blending anchors. This leads also to efficient off-line calculation, even for large speech databases. From equations (7) and (8), it is apparent that attention must be paid to two aspects in the concatenation interval: low energy and high waveform similarity.

Listening experiments suggest that in comparison with unsynchronized waveform blending, concatenation artifacts can be reduced by performing synchronized waveform blending that takes into account minimum energy conditions only, i.e. by selecting the blending anchors $E_1$ and $E_2$ through the minimization of the following error function:

$$\xi_{Engy}(E_1, E_2) = \sum_{n=-D}^{D}\left(x_1(n+E_1)\cos\left(\frac{n\pi}{2D}\right)\right)^2 + \sum_{n=-D}^{D}\left(x_2(n+E_2)\cos\left(\frac{n\pi}{2D}\right)\right)^2$$

The above minimization criterion treats the two waveforms independently (absence of cross term), enabling the process for off-line calculation. In other words, the first blending anchor $E_1$ is determined by minimizing $$\sum_{n=-D}^{D}\left(x_1(n+E_1)\cos\left(\frac{n\pi}{2D}\right)\right)^2$$

and the second blending anchor $E_2$ is determined by minimizing $$\sum_{n=-D}^{D}\left(x_2(n+E_2)\cos\left(\frac{n\pi}{2D}\right)\right)^2$$

In the following, these will be called the minimum energy anchors.

In order to find the minimum energy anchors, the above terms would be calculated for different values of $E_1$ and $E_2$ in the optimization interval. That is time-consuming. In general, the two optimization intervals over which $E_1$ and $E_2$ may vary are convex intervals. The weighted energy calculation can be calculated as a sliding weighted energy, and this is a candidate for optimization.

Assume x is the signal from which to compute the sliding weighted energy. The weighting is done by means of a point-wise multiplication of the signal x by a window. In the most straightforward way, the calculation of the weighted energy may be implemented as:

$$e_n = \sum_{k=n-M}^{n+M} w_{k-n}x_k^2 \quad n = 0, 1, \ldots, N \tag{9}$$

This requires 2(M+1)(N+1) multiplications and 2M (N+1) additions, assuming that the signal x is squared and stored in a buffer only once before windowing. If the window can be expressed as a trigonometric sum (such as the Hanning, Hamming and Blackman windows), then the computational complexity can be reduced drastically.

Take the Hanning window (i.e. raised cosine window) as an example:

$$w_n = \cos^2\left(\frac{\pi n}{2M}\right) \quad n = -M, \ldots, 0, \ldots, M$$

This can be re-written as:

$$w_n = \frac{1}{2}\left(1 + \cos\left(\frac{\pi n}{M}\right)\right) \quad n = -M, \ldots, 0, \ldots, M \tag{10}$$

The calculation of the energy based on a raised cosine window is obtained by substituting equation (10) in equation (9), resulting in:

$$e_n = \sum_{k=n-M}^{n+M} x_k^2 + \sum_{k=n-M}^{n+M} \cos\left(\frac{(k-n)\pi}{M}\right) x_k^2 \quad n = 0, 1, \ldots, N$$

The weighted energy consists clearly out of two terms: $e_n = e_n^u + e_n^c$; an unweighted short-term energy $$e_n^u = \frac{1}{2}\sum_{k=n-M}^{n+M} x_k^2$$

and an energy modulation term $$e_n^c = \frac{1}{2}\sum_{k=n-M}^{n+M} \cos\left(\frac{(k-n)\pi}{M}\right) x_k^2$$

These two energy components can be calculated recursively. Assuming that $e_n^u$ is known, the next term $e_{n+1}^u$ may be expressed as a function of $e_n^u$:

$$e_{n+1}^u = \frac{1}{2}\sum_{k=n+1-M}^{n+1+M} x_k^2 = e_n^u + \frac{1}{2}(x_{n+1+M}^2 - x_{n-M}^2)$$

A recursive formulation of the modulated energy term can be obtained by means of some simple math, based on some well-known trigonometric relations:

$$e_{n+1}^c = \frac{1}{2}\cos\left(\frac{\pi}{M}\right)\sum_{k=n-M}^{n+M} \cos\left(\frac{(k-n)\pi}{M}\right) x_k^2 + \frac{1}{2}\sin\left(\frac{\pi}{M}\right)\sum_{k=n-M}^{n+M} \sin\left(\frac{(k-n)\pi}{M}\right) x_k^2 - \frac{1}{2}x_{n+1+M}^2 + \frac{1}{2}\cos\left(\frac{\pi}{M}\right) x_{n-M}^2$$

If we define $$e_n^s = \frac{1}{2}\sum_{k=n-M}^{n+M} \sin\left(\frac{(k-n)\pi}{M}\right) x_k^2,$$

then the following recursion is obtained:

$$e_{n+1}^c = \left(e_n^c + \frac{1}{2}x_{n-M}^2\right)\cos\left(\frac{\pi}{M}\right) + e_n^s \sin\left(\frac{\pi}{M}\right) - \frac{1}{2}x_{n+1+M}^2$$

A recursive formulation for $e_n^s$ is obtained by applying some some well-known trigonometric relations:

$$e_{n+1}^s = e_n^s \cos\left(\frac{\pi}{M}\right) - \left(e_n^c + \frac{1}{2}x_{n-M}^2\right)\sin\left(\frac{\pi}{M}\right)$$

The waveform synchronization algorithm that is described below requires only the location of the minimum energy and a comparison of the minimum energy of the left segment with the minimum energy of the right segment. Therefore, the factor ½ may be omitted in the definition of the window (10), resulting in simpler expressions. Thus, we assume that A is the time-index corresponding to the first weighted energy value. We also assume that the interval length over which we calculate the weighted energy is N. This leads to the following efficient algorithm:

Square x in the Interval of Interest and Store in Buffer

Algorithm $u_k = x_k^2 k = [A-M, A+N+M]$

Complexity zero additions and N+2M+1 multiplications.

Calculate Start Values

Algorithm $$e_A^u = \sum_{k=A-M}^{A+M} u_k$$

$$e_A^c = \sum_{k=A-M}^{A+M} \cos\left(\frac{(k-A)\pi}{M}\right) u_k$$

$$e_A^s = \sum_{k=A-M}^{A+M} \sin\left(\frac{(k-A)\pi}{M}\right) u_k$$

$$e_A = e_A^u + e_A^c$$

Complexity

2(3M+2) additions and 2(2M+1) multiplications

Use the Following Recursive Relations to Calculate the Other Values

Algorithm $$\begin{cases} e_{n+1}^u = e_n^u + (u_{n+1+M} - u_{n-M}) \\ e_{n+1}^c = (e_n^c + u_{n-m})\cos\left(\frac{\pi}{M}\right) + e_n^s \sin\left(\frac{\pi}{M}\right) - u_{n+1+M} \\ e_{n+1}^s = -(e_n^c + u_{n-m})\sin\left(\frac{\pi}{M}\right) + e_n^s \cos\left(\frac{\pi}{M}\right) \\ e_{n+1} = e_{n+1}^u + e_{n+1}^c \end{cases}$$

$$n = A, A+1, \ldots, A+N-1$$

Complexity
7N additions and 4N multiplications.

Overall Complexity
7N+6M+4 additions
5N+6M+3 multiplications

N and 2M are of the same order and much larger than 10. This means that the approximate gain in computational efficiency is $$\approx \frac{N^2}{10N} = \frac{N}{10}.$$

At 22 kHz with N=150, we get an efficiency gain factor of 15.

Unfortunately some concatenation artifacts remain audible if the synchronization is based solely on the minimum energy anchors because waveform similarity is completely neglected. This problem can be addressed by introducing a second optimization criterion that incorporates waveform similarity and thus further reduces the concatenation artifacts.

In one representative embodiment, the time position of the largest peak or trough of the low-pass filtered waveform in the local neighborhood of the join is used in the waveform similarity process. The waveform similarity process may synchronize the left and right signal based on the position of the largest peak instead of using an expensive cross-correlation criterion. The low-pass filter serves to avoid picking up spurious signal peaks that may differ from the peak corresponding to the (lower) harmonics contributing most to the signal power of the voiced speech. The order of the low-pass filter is moderate to low and is sampling-rate dependent. For example, the low-pass filter may be implemented as a multiplication-free nine-tap zero-phase summator for speech recorded at a sampling-rate of 22 kHz.

The decision to synchronize on the largest peak or trough depends on the polarity of the recorded waveforms. In most languages, voiced speech is produced during exhalation resulting in a unidirectional glottal airflow causing a constant polarity of the speech waveforms. The polarity of the voiced speech waveform can be detected by investigating the direction of pulses of the inverse filtered speech signal (i.e. residual signal), and may often also be visible by investigating the speech waveform itself. The polarity of any two speech recordings is the same despite the non stationary character of the speech as long as certain recording conditions remain the same, among others: the speech is always produced on exhalation and the polarity of the electric recording equipment is unchanged in time.

In order to achieve optimal waveform similarity (i.e. maximum cross-correation) the waveforms of the voiced segments to be concatenated should have the same polarity. However, if the recording equipment settings that control the polarity change over time it is still possible to transform the recorded speech waveforms that are affected by a polarity change by multiplying the sample values by minus one, such that their polarity is of all recordings is the same.

Listening experiments indicate that the best concatenation results are obtained by synchronization based on the largest peaks, if the largest peaks have higher average magnitude than the lowest troughs (this observed over many different speech signals recorded with the same equipment and recording conditions, for example, a single speaker speech database). In the other case, the lowest troughs are considered for synchronization. In what follows, those peaks or troughs used for synchronization are called the synchronization peaks. (The troughs are then regarded as negative peaks.) Listening experiments further indicate that waveform synchronization based on the location of the synchronization peaks alone results in a substantial improvement compared with unsynchronized concatenation. A further improvement in concatenation quality can be achieved by combining the minimum energy anchors with the synchronization peaks.

Figure 4:
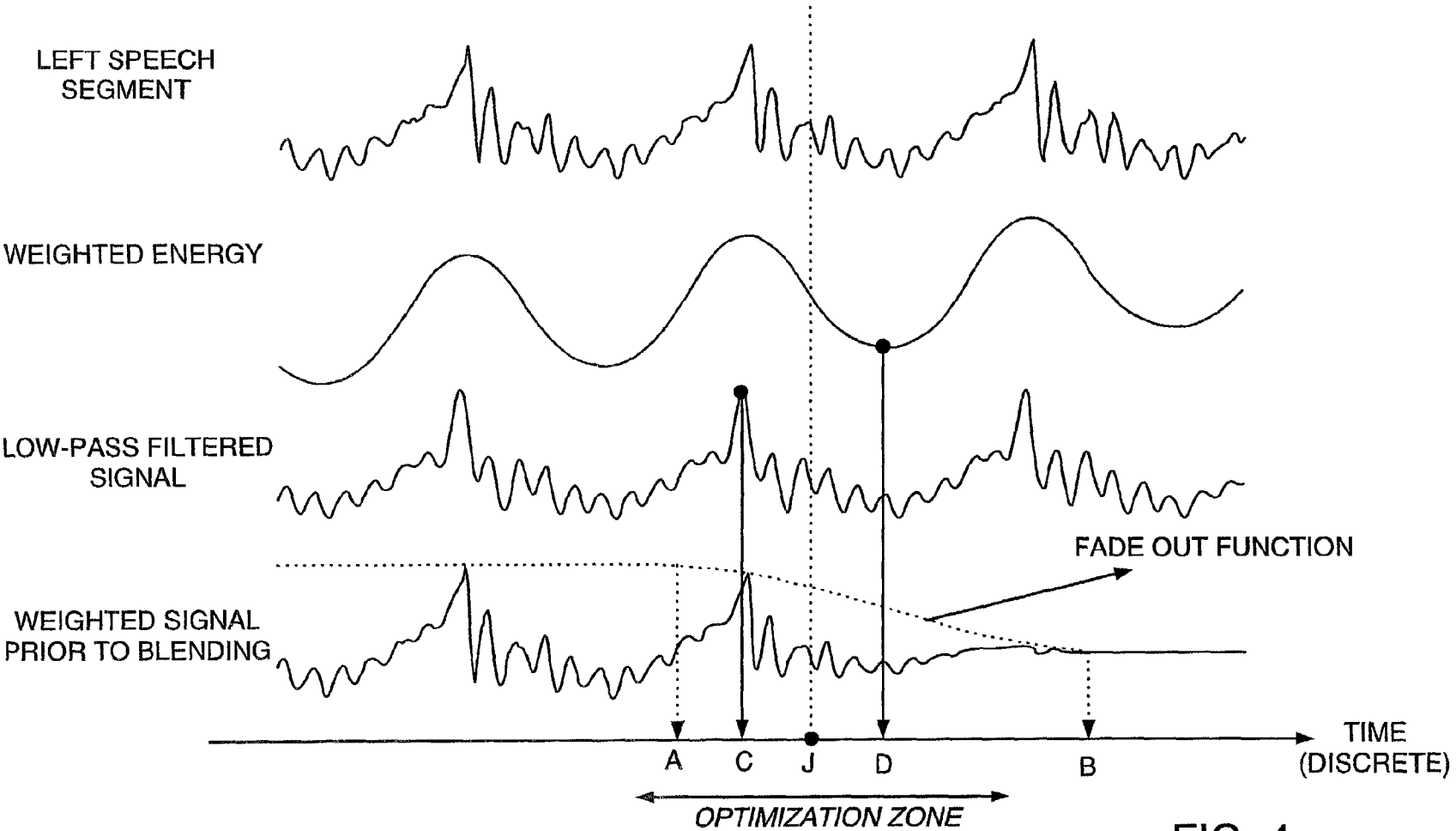
FIG. 4 shows how the blending anchor is calculated based on some features of the signal in the neighborhood of the join.

FIG. 4 shows the left speech segment in the neighborhood of the join J. The join J identifies an interval where concatenation can take place. The length of that interval is typically in the order of one to more pitch periods and is often regarded as a constant. In FIG. 4, the weighted energy, the low-pass filtered signal and the weighted signal (fade-out) are also shown. For reasons of clarity, the signals are scaled differently. FIG. 4 helps to understand the process of determining the anchors of the left segment. Time-index D indicates the location of minimum weighted energy in the neighborhood of the join J. This is the so-called minimum energy anchor as defined above. In this particular case, it is assumed that the first blending anchor is taken as that minimum energy anchor (A more detailed discussion on the anchor selection can be found in the algorithm descriptions below).

In a representative embodiment, the middle of the concatenation zone is assumed to correspond to the blending anchor D. Time-index A from FIG. 4 corresponds with the start of the concatenation zone (i.e. fade-out interval), and time-index B indicates the end of the concatenation zone. D corresponds to A plus the half of the fade-out interval. However, this is not a strict condition for this invention. (For example, a fade-out function that differs from 0.5 at its center may result in different positions of the fade-out interval with respect to the blending anchor.) C is the time-index corresponding to the synchronization peak in the neighborhood of the minimum energy anchor. Synchronization requires the synchronization peaks of the two adjoining segments to coincide when the waveforms in the fade-in and fade-out zones are overlapped. If the synchronization peak for the right segment is given by C', then synchronization requires the blending anchor for the right segment to be equal to D'=C'−(C−D). The resulting blending anchor D' defines the position of the fade-in interval of the right segment. The fade-in and fade-out intervals have the same length as they are overlapped during waveform blending to form the concatenation zone.

The left and right optimization zones for both segments are assumed to be known in advance, or to be given by the application that uses segment concatenation. For example, in a diphone synthesizer the optimization zone of the left (i.e. first) waveform corresponds to the region (typically in the nucleus part of the right phoneme of the diphone) where the diphone may be cut, and the optimization zone of the right (i.e. second) waveform corresponds to the location of the left phoneme of the right diphone where the diphone may be cut. These cutting locations are typically determined by means of (language-dependent) rules, or by means of signal processing techniques that search for stationarity for example. The cutting locations for TSM application are obtained in a different way by slicing the speech into short (typically equidistant) frames of speech.

An implementation of the synchronization algorithm to concatenate a left and a right waveform segment consists of the following steps:

1. Search in the optimization zone located in the trailing part of the left waveform segment and the optimization zone located in the leading part of the right digital waveform segment for the minimum energy anchors; for example, using the efficient sliding weighted energy calculation algorithm described above. The optimization zone is preferably a convex interval around the join that has a length of at least one pitch period.
2. Based on the left and right low-pass filtered speech signals, the two synchronization peaks are searched for in the (close) neighborhood of the two minimum energy anchors obtained in step 1. The "neighborhood" of a minimum energy anchor corresponds to a convex interval that includes the minimum energy anchor and that has preferably a length of at least one pitch period. A typical choice of the "neighborhood" could be the optimization interval for example.
3. A first blending anchor is chosen as the minimum energy anchor that corresponds to the lowest energy. This choice minimizes one of the minimum energy conditions. The other blending anchor that resides in the other speech waveform segment is chosen in such a way that the synchronization peaks coincide when the waveforms are (partly) overlapped in the concatenation zone prior to blending.

Although less optimal, the algorithm may also work if the synchronization does not take into account the value of the minimum weighted energy of the two minimum energy anchors (as described in step 3). This corresponds to blind assignment of a minimum energy anchor to a blending anchor. In this approach one (left or right) minimum energy anchor is systematically chosen as the blending anchor. In this case, the calculation of the other minimum energy anchor is superfluous and can thus be omitted.

In a representative embodiment, the length of the concatenation zone is is taken as the maximum pitch period of the speech of a given speaker; however, it is not necessary to do so. One could, for example, instead take the maximum of the local pitch period of the first segment and the local pitch period of the second segment or a larger interval.

In another variant of the fast synchronization algorithm, the function of the synchronization peak and the minimum energy anchors can be switched:

1. Search in the optimization zone located in the trailing part of the left waveform segment and the optimization zone located in the leading part of the right digital waveform segment for the synchronization peaks based on the left and right low-pass filtered speech waveform segments.
2. The two minimum energy anchors are searched for in the (close) neighborhood of the two synchronization peaks obtained in step 1. The close "neighborhood" of a synchronization peak corresponds to a convex interval that includes the synchronization peak and that has a length preferably larger than one pitch period. A typical choice of the "neighborhood" could be the optimization interval for example.
3. A first blending anchor is chosen as the minimum energy anchor that corresponds to the lowest energy. This choice minimizes one of the minimum energy conditions. The other blending anchor that resides in the other speech waveform segment is chosen in such a way that the synchronization peaks coincide when the waveforms are partly overlapped in the concatenation zone prior to blending.

Analogously as discussed above, the algorithm can also work if the synchronization does not take into account the value of the minimum weighted energy corresponding to the two minimum energy anchors (as described in step 3). This corresponds to a blind assignment of a minimum energy anchor to a blending anchor. In this approach one (left or right) minimum energy anchor is systematically chosen as the blending anchor. This means that in this case the calculation of the other minimum energy anchor is superfluous and can thus be omitted.

In the algorithms described above, some alternatives for the synchronization peak may be used such as the maximum peak of the derivative of the low-pass filtered speech signal, or the maximum peak of the low-pass filtered residual signal that is obtained after LPC inverse filtering.

Figure 2:
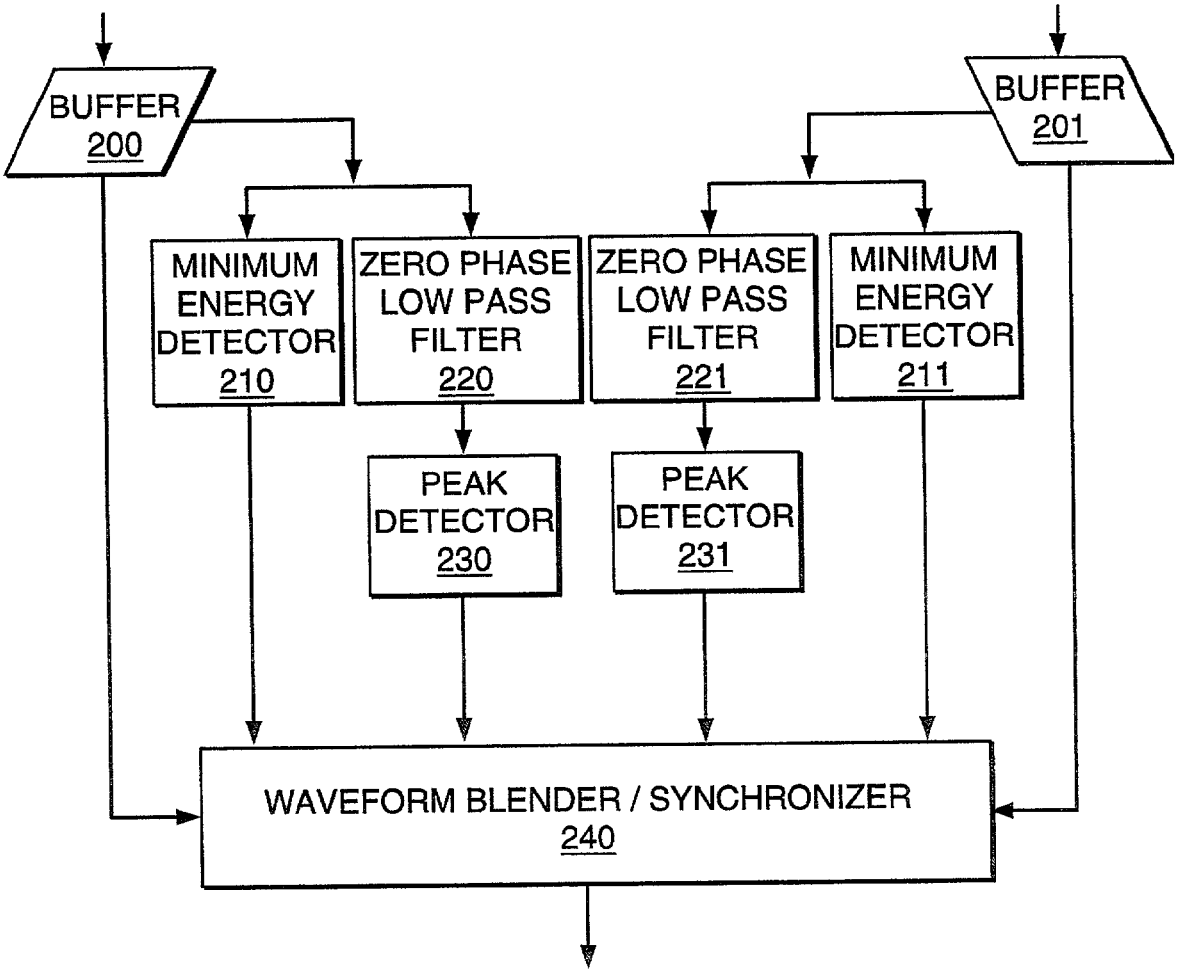
FIG. 2 gives a general functional view of the waveform synchronizer and blender.

A functional diagram of the speech waveform concatenator is given in FIG. 2, which shows the synchronization and blending process. A part of the trailing edge of the left (first) waveform segment, larger than the optimization zone, is stored in buffer 200. The part of the leading edge of the second waveform segment of a size, larger than the optimization zone is stored in a second buffer 201.

In an embodiment of the invention, the minimum energy anchor of the waveform in the buffer 200 is calculated in the minimum energy detector 210, and this information is passed on to the waveform blender/synchronizer 240 together with the value of the minimum weighted energy at the minimum energy anchor. Analogously, the minimum energy detector 211 performs a search to detect the minimum energy anchor point of the waveform stored in buffer 201 and passes it on together with the corresponding weighted energy value to the waveform blender/synchronizer 240. (In another embodiment of the invention, only one of the two minimum energy detectors 210 or 211 are used to select the first blending anchor.) For some applications, such as TTS, the position of the minimum energy anchors can be stored off-line, resulting in a faster synchronization. In the latter case, the minimum energy detection process is equivalent to a table lookup.

Next, the waveform from buffer 200 is low-pass filtered with a zero-phase filter 220 to generate another waveform. This new waveform is then subjected to a peak-picking search 230 taking into account the polarity of the waveforms (as described above). The location of the maximum peak is passed to the waveform blender/synchronizer 240. On the signal from buffer 201, the same processing steps are carried out by the zero-phase low-pass filter 221 and peak detector 231, which results in the location of the other synchronization peak. This location is send to the waveform blender/synchronizer 240.

As described above, the waveform blender/synchronizer 240 selects a first blending anchor based on the energy values, or based on some heuristics and a second blending anchor based on the alignment condition of the synchronization peaks. The waveform blender/synchronizer 240 overlaps the fade-out interval of the left (first) waveform segment and the fade-in region of the right (second) waveform segment that are obtained from the buffers 200 and 201, before weighting and adding them. The weighting and adding process is well known in the art of speech processing and is often referred to as (weighted) overlap-and-add processing.

Storage of Features

Because of the high computational efficiency of the synchronization algorithm used, for many applications it is not necessary that the parameters that are used in the synchronization process be calculated off-line and stored. However, in some critical cases it might be useful to store one or more synchronization parameters. In general, the minimum energy anchors are stored because of the large gain in computational efficiency and because they are independent of the adjoining waveform. In a TTS system, for example, the computational load may be reduced by storing those features in tables. Most TTS systems use a table of diphone or polyphone boundaries in order to retrieve the appropriate segments. It is possible to "correct" this polyphone boundary table by replacing the boundaries by their closest minimum energy anchor. In the case of a TTS system, this approach requires no additional storage and reduces the CPU load for synchronization significantly. However, on some hardware systems it might be useful to store the closest synchronization anchors instead of the closest minimum energy anchors.

What is claimed is:

1. A digital waveform concatenation system for use in an acoustic processing application, the system comprising:

a digital waveform provider that produces an input sequence of at least two digital waveform segments, each waveform segment being a sequence of samples; and a waveform concatenator that:

i. synchronizes input waveform segments to form a sequence of partially overlapping waveform segments, and ii. weights and adds selected portions of the overlapping waveform segments to concatenate the input waveform segments so as to produce a single digital waveform;

wherein for segments of voiced speech, the synchronizing includes aligning a minimum energy anchor in each waveform segment with a corresponding minimum energy anchor of an adjacent waveform segment, each minimum energy anchor location in a given segment being optimized based on determining minimum weighted energy in a neighborhood of a boundary of the given segment.

2. A concatenation system according to claim 1, wherein the acoustic processing application includes a text-to-speech application.

3. A concatenation system according to claim 1, wherein the acoustic processing application includes a speech broadcast application.

4. A concatenation system according to claim 1, wherein the acoustic processing application includes a carrier-slot application.

5. A concatenation system according to claim 1, wherein the acoustic processing application includes a time-scale modification system.

6. A concatenation system according to claim 1, wherein the waveform segments include at least one of speech diphones and speech triphones.

7. A concatenation system according to claim 1, wherein the waveform segments include at least one of speech phones and speech demi-phones.

8. A concatenation system according to claim 1, wherein the waveform segments include at least one of speech demi-syllables, speech syllables, words, and phrases.

9. A concatenation system according to claim 1, wherein determining minimum weighted energy in the selected portion includes using a sliding weighted energy calculation algorithm.

10. A concatenation system according to claim 1, wherein the input segments are filtered before synchronizing.

11. A concatenation system according to claim 1, wherein aligning minimum energy anchors includes determining a largest waveform peak or trough in the close neighborhood of each minimum energy anchor.

12. A concatenation system according to claim 11, wherein the close neighborhood is an interval of at least one pitch period containing the minimum energy anchor.

13. A concatenation system according to claim 11, wherein the close neighborhood is the selected portion of the input segment.

14. A concatenation system according to claim 11, wherein the location of one minimum energy anchor is the lowest weighted energy location in the selected portion.

15. A concatenation system according to claim 14, wherein another minimum energy anchor location is chosen such that the previously determined waveform peak or trough in each selected portion coincide when the input segments are overlap-added.

16. A digital waveform concatenation system for use in an acoustic processing application, the system comprising:

a digital waveform provider that produces an input sequence of at least two digital waveform segments, each waveform segment being a sequence of samples; and a waveform concatenator that:

i. synchronizes successive waveform segments to form a sequence of partially overlapping waveform segments, the overlapping portion of each waveform segment including an optimization zone near a waveform segment boundary, and ii. weights, and adds selected portions of the input segments to concatenate the input segments so as to produce a single digital waveform;

wherein for segments of voiced speech, the synchronizing includes aligning a largest waveform peak or trough in the optimization zone of each input waveform segment with a corresponding largest waveform peak or trough in an optimization zone of an adjacent waveform segment.

17. A concatenation system according to claim 16, wherein the acoustic processing application includes a text-to-speech application.

18. A concatenation system according to claim 16, wherein the acoustic processing application includes a speech broadcast application.

19. A concatenation system according to claim 16, wherein the acoustic processing application includes a carrier-slot application.

20. A concatenation system according to claim 16, wherein the waveform segments include at least one of speech diphones and speech triphones.

21. A concatenation system according to claim 16, wherein the waveform segments include at least one of speech phones and speech demi-phones.

22. A concatenation system according to claim 16, wherein the waveform segments include at least one of speech demi-syllables, speech syllables, words, and phrases.

23. A concatenation system according to claim 16, wherein the input segments are filtered before aligning.

24. A digital waveform concatenation system for use in an acoustic processing application, the system comprising:

a digital waveform provider that produces an input sequence of at least two digital waveform segments, each waveform segment being a sequence of samples; and a waveform concatenator that:

i. synchronizes successive waveform segments to form a sequence of partially overlapping waveform segments, and ii. weights and adds selected portions of the overlapping waveform segments to concatenate the input waveform segments so as to produce a single digital waveform;

wherein for segments of voiced speech, the synchronizing includes aligning synchronization peaks or troughs in selected portion of each input waveform segment with synchronization peaks or troughs in a corresponding selected portion of an adjacent waveform segment, the location of the selected portions being determined by searching in a neighborhood of waveform segment boundaries for a location where the sum of the weighted energy of the selected portions is minimal.

25. A concatenation system according to claim 24, wherein the acoustic processing application includes a text-to-speech application.

26. A concatenation system according to claim 24, wherein the acoustic processing application includes a speech broadcast application.

27. A concatenation system according to claim 24, wherein the acoustic processing application includes a carrier-slot application.

28. A concatenation system according to claim 24, wherein the acoustic processing application includes a time-scale modification system.

29. A concatenation system according to claim 24, wherein the waveform segments include at least one of speech diphones and speech triphones.

30. A concatenation system according to claim 24, wherein the waveform segments include at least one of speech phones and speech demi-phones.

31. A concatenation system according to claim 24, wherein the waveform segments include at least one of speech demi-syllables, speech syllables, words, and phrases.

32. A concatenation system according to claim 24, wherein determining a minimum weighted energy anchor includes using a sliding weighted energy calculation algorithm.

33. A concatenation system according to claim 24, wherein the input segments are filtered before synchronizing.

34. A concatenation system according to claim 24, wherein aligning synchronization peaks or troughs includes determining a largest waveform peak or trough in the close neighborhood of each anchor.

35. A concatenation system according to claim 34, wherein the close neighborhood is an interval of at least one pitch period containing the minimum energy anchor.

36. A concatenation system according to claim 34, wherein the close neighborhood is the selected portion of the input segment.

37. A concatenation system according to claim 34, wherein the location of one anchor is chosen such that the synchronization peaks or troughs in each selected portion coincide when the input segments are overlap-added.

38. A digital waveform concatenation system for use in an acoustic processing application, the system comprising:

a digital waveform provider that produces an input sequence of at least two digital waveform segments, each waveform segment being a sequence of samples; and a waveform concatenator that:

i. synchronizes successive waveform segments to form a sequence of partially overlapping waveform segments, and ii. weights, and adds selected portions of the overlapping waveform segments to concatenate the input waveform segments so as to produce a single digital waveform;

wherein for pairs of overlapping segments of voiced speech, a first selected portion includes a minimum energy anchor in a location optimized based on determining minimum weighted energy in a neighborhood of the waveform segment boundaries, and a second selected portion is determined by aligning synchronization peaks or troughs in the neighborhood of the waveform segment boundaries.

39. A concatenation system according to claim 38, wherein the acoustic processing application includes a text-to-speech application.

40. A concatenation system according to claim 38, wherein the acoustic processing application includes a speech broadcast application.

41. A concatenation system according to claim 38, wherein the acoustic processing application includes a carrier-slot application.

42. A concatenation system according to claim 38, wherein the acoustic processing application includes a time-scale modification system.

43. A concatenation system according to claim 38, wherein the waveform segments include at least one of speech diphones and speech triphones.

44. A concatenation system according to claim 38, wherein the waveform segments include at least one of speech phones and speech demi-phones.

45. A concatenation system according to claim 38, wherein the waveform segments include at least one of speech demi-syllables, speech syllables, words, and phrases.

46. A concatenation system according to claim 38, wherein determining a minimum weighted energy anchor includes using a sliding weighted energy calculation algorithm.

47. A concatenation system according to claim 38, wherein the input segments are filtered before synchronizing.

48. A concatenation system according to claim 38, wherein aligning synchronization peaks or troughs includes determining a largest waveform peak or trough in the close neighborhood of the anchor and determining a corresponding peak or trough in the selected portion of the other input segment.

49. A concatenation system according to claim 48, wherein the close neighborhood is an interval of at least one pitch period containing the minimum weighted energy anchor.

50. A concatenation system according to claim 48, wherein the close neighborhood is the selected portion of the input segment.

* * * * *

UNITED STATES PATENT AND TRADEMARK OFFICE

CERTIFICATE OF CORRECTION

PATENT NO. : 7,058,569 B2
APPLICATION NO. : 09/953075
DATED : June 6, 2006
INVENTOR(S) : Geert Coorman et al.

It is certified that error appears in the above-identified patent and that said Letters Patent is hereby corrected as shown below:

On title page, Item (54) replace "Fast Waveform Synchronization for Concentration and Time-Scale Modification of Speech" with "Fast Waveform Synchronization for Concatenation and Time-Scale Modification of Speech"

Signed and Sealed this
Tenth Day of July, 2012

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,058,569 B2
APPLICATION NO. : 09/953075
DATED : June 6, 2006
INVENTOR(S) : Geert Coorman et al.

It is certified that error appears in the above-identified patent and that said Letters Patent is hereby corrected as shown below:

On title page, Item (54) and at Column 1, lines 1-3, Title, replace "Fast Waveform Synchronization for Concentration and Time-Scale Modification of Speech" with "Fast Waveform Synchronization for Concatenation and Time-Scale Modification of Speech"

This certificate supersedes the Certificate of Correction issued July 10, 2012.

Signed and Sealed this
Fourteenth Day of August, 2012

David J. Kappos

David J. Kappos
*Director of the United States Patent and Trademark Office*